United States Patent [19]

Novotny et al.

[11] Patent Number: 5,046,929

[45] Date of Patent: Sep. 10, 1991

[54] SEAL COMPRESSOR

[75] Inventors: Shlomo Novotny, Hudson, Mass.; Mark Kushnir, Rebhovot; Ran Yaron, Tel-Aviv, both of Israel

[73] Assignee: Digital Equipment Corporation, Maynard, Mass.

[21] Appl. No.: 336,059

[22] Filed: Apr. 11, 1989

[30] Foreign Application Priority Data

Apr. 27, 1988 [IL] Israel ..... 86201

[51] Int. Cl.[5] ..... F04B 39/04

[52] U.S. Cl. ..... 417/439; 417/414

[58] Field of Search ..... 417/392, 414, 437, 439

[56] References Cited

U.S. PATENT DOCUMENTS

| | | | |
|---|---|---|---|
| 1,661,661 | 3/1928 | Greenwald | 417/439 |
| 1,670,799 | 5/1928 | Dornbirer | 417/439 |
| 3,640,082 | 2/1972 | Dehne | 417/439 X |
| 4,556,369 | 12/1985 | Braun | 417/437 |

*Primary Examiner*—John C. Fox

*Attorney, Agent, or Firm*—Jones, Tullar & Cooper

[57] ABSTRACT

A piston-type compressor includes a cylinder having a liner sleeve in which is mounted a reciprocating piston driven by a crankshaft through a connecting rod. The piston forms a dynamic seal with the sleeve with the volume above the piston head defining a first, or compression chamber. Connected between the piston and the compressor cylinder is a flexible sealing element such as a bellows which defines a second, isolating chamber between the bellows and the dynamic seal and which further defines a third, or crankcase chamber between the bellows and the region of the compressor which includes the crankcase. The volumes in the second and third chambers are chosen so that the pressures therein are generally equal. A bypass filter assists in eliminating the pressure differential across the bellows during startup by maintaining the pressure within the intermediate and crankcase chambers substantially equal. The bellows and bypass filter cooperate to prevent contamination from the crankcase from reaching the isolating chamber or the compression chamber.

9 Claims, 2 Drawing Sheets

SEAL COMPRESSOR

FIELD OF THE INVENTION

The present invention relates to compressors in general, and more particularly to compressors having seals to prevent contamination of the working gas volume.

BACKGROUND OF THE INVENTION

One of the major factors limiting the operating life time of cryocoolers and other devices employing reciprocating piston compressors is contamination of the working gas volume by lubricants and other debris. For example, conventional Stirling cycle cryocoolers have a measured reliability of 300 hours MTBF. Four major failure modes have been identified in these cryocoolers: rotary bearing failure, compressor piston seal failure, contamination of the working gas volume by debris and lubricants, and helium leakage.

Seals, and in particular compressor piston seals, do not effect total sealing of the gas in the compression chamber portion of the working volume of the compressor. As a result, contaminant particles are transported into the compression chamber by gas Which escapes from that chamber past the seal, and which then returns to &he compression chamber as the compressor operates.

As an alternative type of seal, the use of bellows has been proposed, since a seal employing bellows is known to provide a nominally absolute seal, with gas leaking therepast at less than 0.0000001 cc helium/sec. The prior art, however, did not solve the problem of differential pressure across the bellows and as a result, in use such bellows underwent deformations which caused early fatigue failure.

SUMMARY OF THE INVENTION

It is an object of the present invention to provide an improved compressor having an increased working life and which reduces or eliminates the contamination of the working gas by lubricants from the compressor itself as well as from other contaminating material.

Briefly, and in accordance with a preferred embodiment of the present invention, there is provided a piston-type compressor which is driven by a rotary power source connected to the compressor through a crankshaft. The compressor includes a housing incorporating a cylinder and a crankcase which together define a working volume. A piston is mounted in this working volume and forms a dynamic seal with a sleeve mounted in the side wall of the cylinder, the top of the piston and the side and top walls of the cylinder defining a compression chamber for the compressor. A flexible seal divides the remainder of the working volume into a crankcase chamber Which surrounds the crankshaft and piston rod, and an intermediate isolating chamber between the crankcase chamber and the compression chamber.

The compressor further includes apparatus for substantially eliminating the build up of a differential pressure across the flexible seal which divides the intermediate isolating chamber from the crank case, which build up can be caused by the alternating motion of the piston within the cylinder. In accordance with one embodiment of the invention, the flexible divider between the intermediate and crankcase chambers for separating the two chambers from each other is a bellows.

In accordance with a preferred embodiment of the invention, then, the working volume of the compressor includes a first, or compression chamber, a second or intermediate isolating chamber, and a third or crank case chamber, all of which have variable volumes during the operation of the compressor. The dynamic seal separates the first and second chambers from each other and the bellows separates the second and third chambers.

Further in accordance with the preferred embodiment of the invention, the second and third chambers are constructed so that the pressures therein are generally equal. In order to maintain a general equality of pressures, the second and third chambers always are in a generally constant ratio as they vary due to the motion of the piston.

Additionally in accordance with the invention, in order to compensate for the effects of gas leakage past the dynamic seal around the piston, and the effects of temperature gradients, the apparatus for eliminating the build up of pressure includes a bypass which defines a gas flow path extending between the second and third chambers; that is, between the intermediate chamber in the region of the piston and below the dynamic seal, and the crankcase chamber, including the working volume surrounding the crankcase, piston rod, and any part of the piston below the flexible seal between the second and third chambers. In a preferred form of the invention, the bypass apparatus also includes a filter medium for preventing transport along the bypass flow path of contaminant particles from the crankcase chamber to the intermediate isolating chamber.

In accordance with another aspect of the present invention, a lubricated piston guide is also provided for the compressor piston.

BRIEF DESCRIPTION OF THE DRAWINGS

The foregoing objects, features, and advantages of the present invention will be more fully understood and appreciated from the following detailed description of preferred embodiments thereof taken in conjunction with the accompanying drawings, in which.

DETAILED DESCRIPTION OF THE INVENTION

Figure 1:
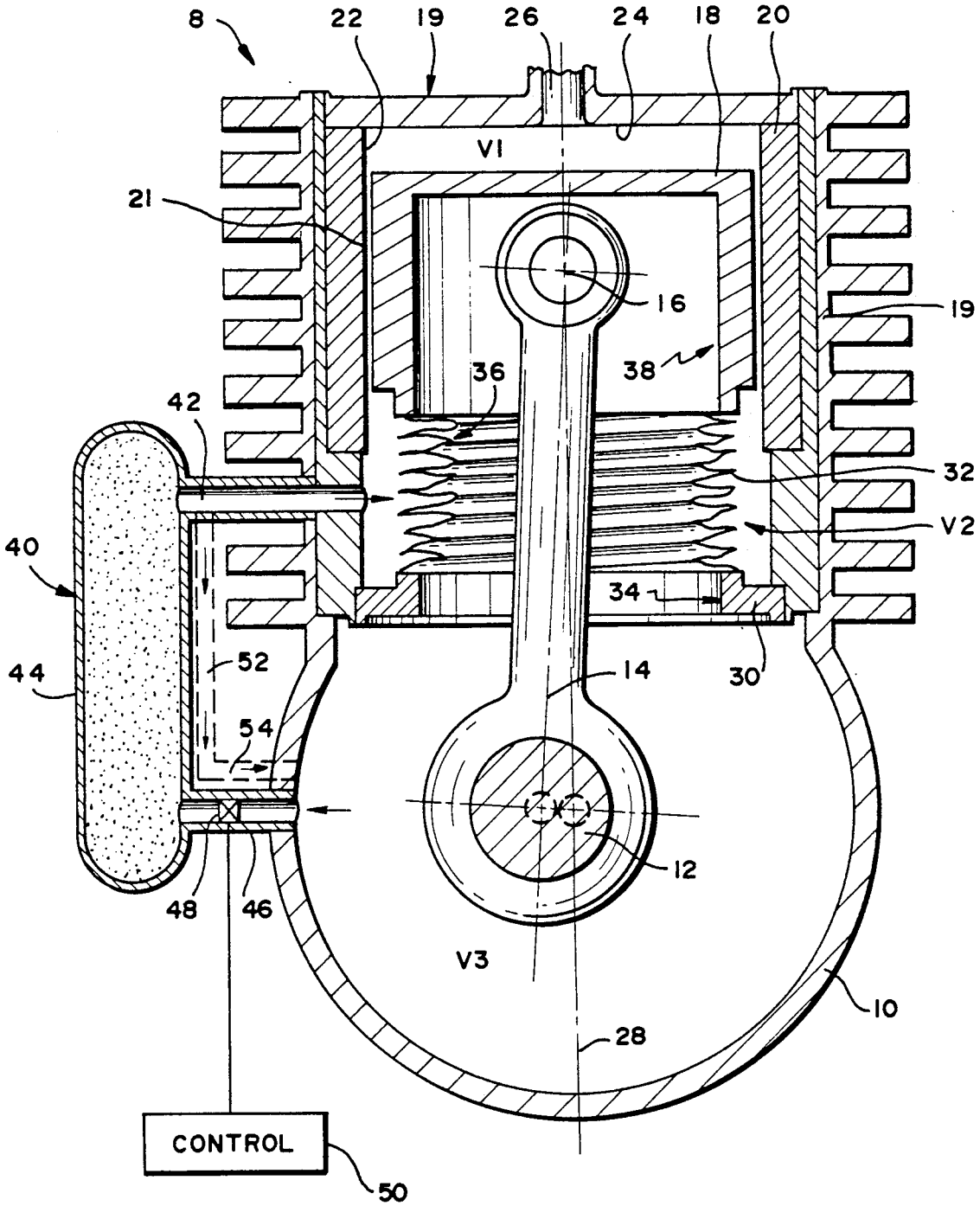
FIG. 1 is a schematic partial cross sectional view of a portion of a compressor, constructed in accordance with a first embodiment of the present invention.

Referring now to FIG. 1, there is illustrated generally at 8 a portion of a piston-type compressor constructed and operative in accordance with a first embodiment of the invention, and including a housing incorporating a crankcase 10 for an eccentrically mounted crankshaft 12. The crankshaft is connected at one end to a drive source (not shown) and carries a connecting rod 14 which is mounted at one end to the crankshaft by means of a suitable bearing. The opposite end of the connecting rod is mounted on a pin 16 which is connected to a piston 18 located in a compressor cylinder generally indicated at 19, which is also a part of the compressor housing. Piston 18 is slidably mounted in a sleeve 20 which is, in turn, mounted in the side wall of the cylinder 19. The piston cooperates with the sleeve 20 to form a dynamic seal therebetween, generally indicated at 21, which substantially prevents the flow of compressed gas from the compression chamber V1 past the piston 18. The piston thus defines, together with an inner surface 22 of sleeve 20 and an inner surface 24 of the top wall of cylinder 19, the compression chamber VI which forms a first variable volume for the housing of compressor 8. The first volume V1 may communicate by means of a channel 26 with a regenerator and heat exchanger (not shown) of a Stirling cryocooler or any other suitable compressor output device.

Piston 18 is mounted for reciprocating movement along an axis 28 towards and away from a crankcase closure member 30 at the bottom of cylinder 19. A flexible sealing member 32, which may be a bellows type seal, is provided between the piston 18 and the closure member 30. As shown, the upper end of the bellows 32 is connected to the bottom circumference of piston 18, while the lower end of the bellows is connected to the inner circumference of the closure member 30. The volume between the outer surface of bellows 32, the inner surface of cylinder 19, the top of closure member 80, and the dynamic seal 21 between the piston 18 and the sleeve 20 defines a second volume V2 which forms the intermediate isolating chamber of the compressor. The crankcase 10 and the inner surface 34 of closure member 30, the inner surface 36 of bellows 32, and the inner surface 38 of piston 18 form a third volume V3 which is the crankcase chamber for the compressor.

The second and third volumes V2 and V3 are selected so that the pressures therein are generally equal so as to prevent deformation of the flexible seal 32. In order to maintain these pressures equal, the two volumes are always in a generally constant ratio. This is achieved in the illustrated embodiment by causing the ratio between the cross sectional area AP of piston 18 and the effective cross sectional area AB of bellows 32 to satisfy the following relationship with the second and third volumes, assuming equal initial pressures in volumes V2 and V3:

$$V2/V8+1=AP/AB$$

It has been found that during a start-up period, that is, between the time that the compressor is activated and the time that steady state conditions prevail, there will be a pressure differential across bellows 82. Such a pressure differential may also occur due to leakage past the dynamic seal 21. Although this pressure differential may be on the order of only about 0.5 atmosphere, it is, nevertheless, desirable to eliminate it. Accordingly, the present invention provides a bypass assembly, generally indicated at 40, for permitting communication between the intermediate isolating chamber V2 and the crankcase chamber V8 so as to substantially eliminate the pressure differential across the bellows, thus preventing its premature failure.

In accordance with one embodiment of the invention, the bypass assembly 40 comprises a first conduit 42 communicating at one end with volume V2 and at the other end with a gas filter 44 and a second conduit 46 communicating at one end with volume V3 and at the other end with filter 44, to define a gas flow path between volume V2 and volume V3. It will be appreciated that any excess pressure tending to build up in either volume V2 or volume V3 Will be dissipated by means of the bypass assembly 40 through the conduits 42 and 46 and the gas filter 44 in communication with the two conduits. Since it has been found that the dynamic seal 21 does not constitute a perfect seal, the gas filter 44 is provided to insure that any contaminant particles that might otherwise have flowed from volume V8 into volume V2, and from therein to volume V1, are prevented from doing so.

In accordance with a preferred form of the present invention, there is provided in conduit 46 a valve 48 for opening and closing the by-pass flow path defined by assembly 40. According to this preferred embodiment, valve 48 is opened only during start up periods. There is also provided, therefore, a pressure responsive control unit 50 for governing the opening and closing of valve 48. This control unit 50 may comprise a conventional pressure responsive valve controller. It will be appreciated that any other suitable apparatus may be provided as an alternative to control unit 50.

In accordance with a further embodiment of the invention, a third conduit 52, shown in dotted lines in FIG. 1, may be provided to dissipate excess pressures that might otherwise build up within the isolating chamber defined by volume V2. This conduit includes a one-way valve 54 to prevent undesired flow of gas directly from the crank case chamber V3 back into the isolating volume V2 without passing through the bypass filter 44.

Figure 2:
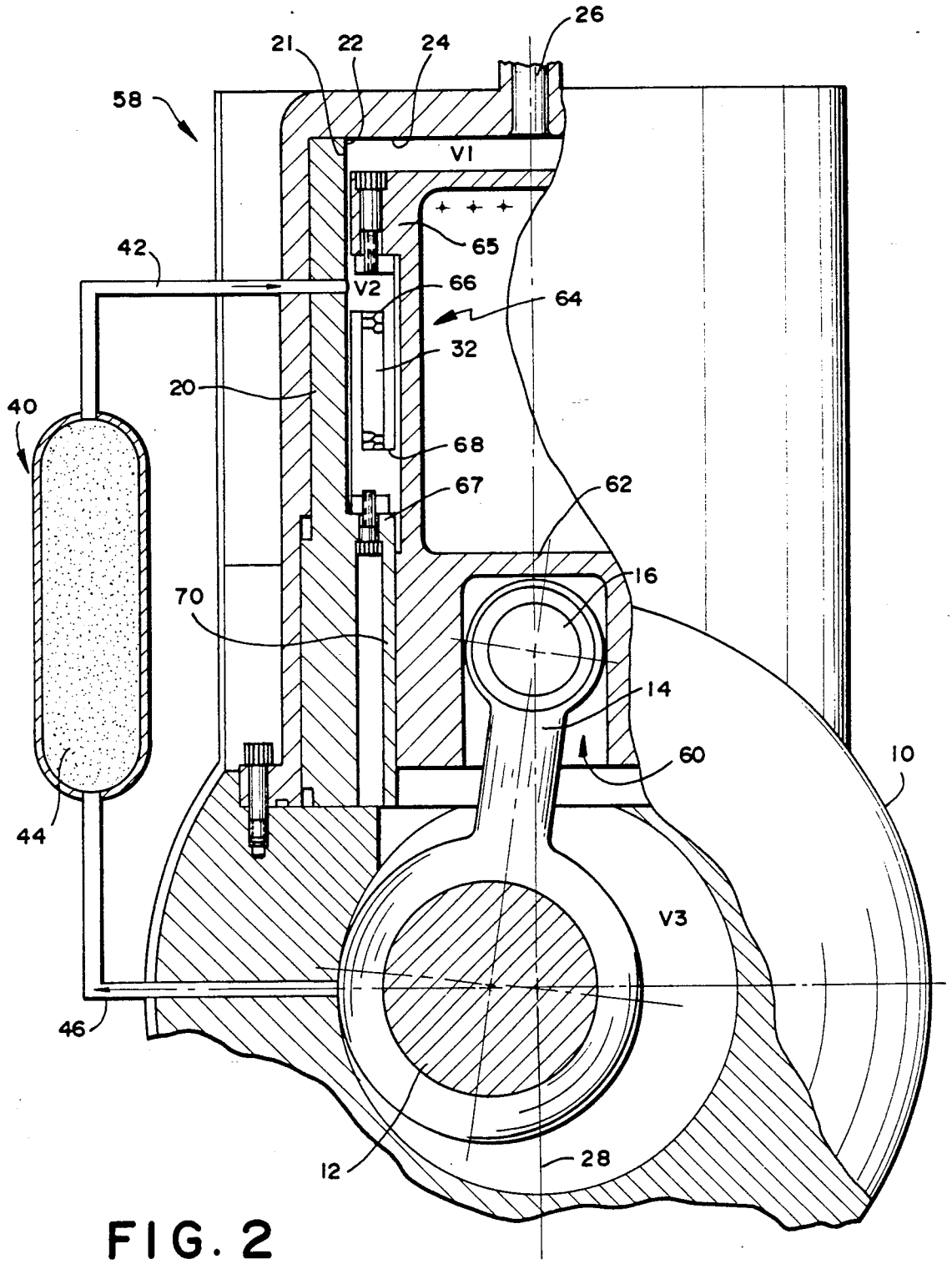
FIG. 2 is a schematic partial cross sectional view of a portion of a rotary compressor, constructed in accordance with a second embodiment of the present invention.

With reference now to FIG. 2, there is illustrated at 58 a partial cross section of a portion of a piston-type compressor which is generally similar to the compressor 8 illustrated in FIG. 1, with common components being indicated by similar reference numerals. In the embodiment of FIG. 2, the connecting rod 14 is mounted, by means of pin 16, onto a lower skirt portion 60 of a piston 62 with the upper, or head portion 64 of the piston incorporating an enlarged portion 65 which cooperates with cylinder sleeve 22 to form a dynamic seal 21. A flexible sealing member 32, which may be a bellows, is mounted between piston 62 and sleeve 20 by means of a first mounting element 66 secured to an inwardly extending shoulder portion 67 of sleeve 20 and a second mounting element 68 secured to the bottom surface of the outwardly extending enlarged shoulder portion 65 of the upper piston head portion 64. The mounting element 66 is spaced below the enlarged portion 65 of the piston a sufficient distance to allow free motion of the piston during operation.

The bellows element 82 is located between the side wall of the piston head and the inner surface of the sleeve 20 and defines, with the dynamic seal 21, the intermediate volume V2. The region below the bellows 32 and including the crank case volume, defines the chamber V3. It will be noted that the lower skirt portion of the piston is mounted in a lubricated guide 70, with typical lubricants being oil, grease or the like. The bellows 32 and its mounting elements 66 and 68 serve to prevent contamination of the volume V1 by such lubricants, for example. As in the embodiment of FIG. 1, the volume V2 is in communication with the volume V8 by way of conduits 42 and 46 connected through a bypass filter 44.

It will be appreciated by persons skilled in the art that the present invention is not limited by what is illustrated and described hereinabove, but that the scope of the invention is limited only by the following claims:

We claim:

1. A compressor comprising:

a housing defining a working volume having first, second and third variable volume portions, a compression cylinder in said housing;

a piston within said cylinder and forming a dynamic seal therewith, a portion of said compression cylinder above said piston and dynamic seal defining said first volume portion of said working volume and a portion of said working volume surrounding said piston below said dynamic seal comprising said second volume portion;

a crankshaft driven by a power source and connected to drive said piston, said crankshaft being located in said third volume portion of said working volume;

bellows means sealing said second volume portion from said third volume portion, the ratio of the cross sectional area of said piston (AP) with respect to the effective cross sectional area of said bellows (AB) and the ratio of the second volume portion (V2) with respect tot he third volume portion (V3) satisfying the following relationship, assuming equal initial pressures in V2 and V3:

$$V2/V3+1=AP/AB$$

whereby said second and third volume portions are maintained in a substantially constant ratio during operation of the compressor to maintain the pressure of fluids in said second and third volumes substantially equal; and means preventing a build up across said bellows means of a differential fluid pressure caused by motion of said piston.

2. A compressor according to claim 1, and wherein said means preventing pressure build-up comprises means defining a fluid flow path extending between the working volume portion surrounding said piston and the working volume portion surrounding said crankshaft.

3. A compressor according to claim 1, and wherein said means preventing pressure build-up comprises means defining a bypass gas flow path extending between the second working volume portion surrounding said piston and the third working volume portion surrounding said crankshaft.

4. A compressor according to claim 3, further including control means for controlling the gas flow along said flow path.

5. A compressor according to claim 1 and also including means permitting unidirectional gas flow from the working volume portion surrounding said piston to the working volume portion surrounding said crankshaft.

6. A compressor according to claim 1 and also including a lubricated piston guide in said cylinder.

7. A compressor comprising:

a housing defining a working volume having first, second and third variable volume portions, a compression cylinder in said housing;

a piston within said cylinder and forming a dynamic seal therewith, a portion of said compression cylinder above said piston and dynamic seal defining said first volume portion of said working volume and a portion of said working volume surrounding said piston below said dynamic seal comprising said second volume portion;

a crankshaft driven by a power source and connected to drive said piston, said crankshaft being located in said third volume portion of said working volume;

bellows means sealing said second volume portion from said third volume portion;

means defining a bypass gas flow path extending between the second working volume portion surrounding said piston and the third working volume portion surrounding said crankshaft, to prevent a buildup across said bellows means of a differential fluid pressure caused by motion of said piston; and filtering means preventing transport along said flow path of contaminant particles from said working volume portion surrounding said crankshaft to said working volume portion surrounding said piston.

8. A compressor according to claim 7, further including a second flow path means permitting one-directional gas flow from said second working volume portion surrounding said piston to said third working volume portion surrounding said crankshaft.

9. A compressor according to claim 8 and also including a lubricated piston guide in said cylinder.

* * * * *